US007955187B2

(12) United States Patent
Bone et al.

(10) Patent No.: US 7,955,187 B2
(45) Date of Patent: Jun. 7, 2011

(54) SWINGWEIGHT ADJUSTED GOLF CLUB SHAFT

(75) Inventors: Donald S. Bone, Carlsbad, CA (US); Dustin A. Barksdale, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 148 days.

(21) Appl. No.: 12/342,617

(22) Filed: Dec. 23, 2008

(65) Prior Publication Data

US 2010/0160065 A1 Jun. 24, 2010

(51) Int. Cl.
*A63B 53/10* (2006.01)
*A63B 53/12* (2006.01)

(52) U.S. Cl. ..... 473/316

(58) Field of Classification Search ..... 473/316–323
See application file for complete search history.

(56) References Cited

U.S. PATENT DOCUMENTS

| | | | | |
|---|---|---|---|---|
| 4,165,874 | A | 8/1979 | Lezatte et al. | |
| 5,735,752 | A | 4/1998 | Antonious | |
| 6,478,689 | B1 * | 11/2002 | Hisamatsu | 473/287 |
| 6,485,376 | B1 * | 11/2002 | Hisamatsu | 473/319 |
| 6,805,642 | B2 | 10/2004 | Meyer et al. | |
| 7,037,212 | B2 * | 5/2006 | Ashida et al. | 473/319 |
| 2003/0176236 | A1 * | 9/2003 | Fendel | 473/312 |
| 2004/0138000 | A1 * | 7/2004 | Braly et al. | 473/316 |
| 2005/0107182 | A1 | 5/2005 | Meyer et al. | |
| 2008/0242438 | A1 | 10/2008 | Sato et al. | |

* cited by examiner

*Primary Examiner* — Stephen L. Blau
(74) *Attorney, Agent, or Firm* — Randy K. Chang

(57) ABSTRACT

An improved golf club shaft and corresponding golf club is disclosed. More specifically, a golf club shaft that is capable of minimizing or eliminating swingweight variations within a golf club despite being cut down to various different lengths to accommodate the length and heads of a set of irons is disclosed. The shaft may have an internal wall profile of variable thickness to adjust for various weight and center of gravity variations of a golf club shaft as it is being cut down in length.

4 Claims, 9 Drawing Sheets

SWINGWEIGHT ADJUSTED GOLF CLUB SHAFT

FIELD OF THE INVENTION

The present invention relates to an improved golf club shaft. More particularly, the present invention relates to a golf club shaft for a set of clubs wherein the internal wall thicknesses of the shafts are shaped in a way that allows the golf club shafts to be cut down to an individually desirable length while minimizing or eliminating the undesirable change in the swingweight within the set of clubs.

BACKGROUND OF THE INVENTION

Golf club shafts have always been an important component of every golf club. Although many would argue that finding a correct golf club head makes the most significant impact on an individual's golf swing, finding the correct golf club shaft to go with the correct golf club head is also just as important. Currently in the art, conventional golf club shafts have been made out of various materials such as steel, metal alloy, or composites that change the various characteristics of the golf club shaft. These materials, although provide significant differences in swing characteristics of a golf club in and of themselves, are incapable of addressing the weight consistency issue within a set of golf clubs. With the development, understanding, and focus on the weight consistency issue of the golf club, it has become known that the consistency of a weight and feel of a golf club depends on more than just the weight of the shaft alone. The weight of the golf club and the way it feels when being swung are generally dependent on two factors; the actual weight of the golf club and the moment of the club around an arbitrary location; which has been called the "swingweight" of a golf club. Understanding swingweight and maintaining the same swingweight is extremely beneficial and desirable to a golfer in order to find a set of golf clubs that feels natural to the individual no matter which club is chosen.

The concept of swingweight is a well known concept within the golfing industry. Swingweight can be generically simplified as the weight relationship of a golf club about a fixed fulcrum point. More specifically, the swingweight is the measurement of a golf club's moment about the fixed fulcrum, generally placed at an arbitrary location fourteen inches away from the butt end of the grip. The swingweight is important to a golf swing because it affects how heavy the club feels during the swing regardless of its actual weight. Golf club sets that are put together without any conscious effort on maintaining the swingweight often have a major flaw in that each club feels and performs differently due to swingweight variations. This swingweight variation described above could be as little as one swingweight, but in severe situations, such variation could result in as much as four swingweights. Major differences in swingweight can significantly affect the feel of a golf club, and is often an undesirable effect. Hence, it can be seen from above that there is a need for a set of golf clubs that maintains a consistent swingweight through the various clubs.

The need for consistent swingweight is particularly prevalent within a set of irons, as they often come in a set of multiple clubs and they are expected to perform consistently within the set. In order to address the swingweight issue within a set of irons, a prevalent approach within the golf industry has been using constant weight shafts. A constant weight shaft aims to maintain the swingweight of each individual shaft within an iron set regardless of the length of the shaft. This constant weight shaft approach is generally achieved by independently manufacturing each shaft to their individual weight, length, and swingweight specifications. As a result of the individualized complicated manufacturing process, all of the shafts within a set of irons will have the same weight and swingweight regardless of the length of the shaft. This individualized and independent manufacturing process takes in consideration the weight of each of the club head, the weight of each of the grip and grip tape, the length of the shaft, and the weight of the shaft to achieve a consistent swingweight. This approach of individually manufacturing each shaft within a set of irons, although effective in maintaining swingweight, can be slow, burdensome, and expensive to manufacture.

In order to minimize production costs while still achieving constant swingweight, it is also common in the golf club industry to adapt a descending weight shaft approach as an alternative to the constant weight shaft approach. The descending weight shaft approach ignores any attempt to maintain individual shaft weight and swingweight across the set of irons. Thus, as the length of the shaft get shorter and shorter, the weight and swingweight of each shaft begin to differ across the set of clubs. Ultimately, as each individual shaft is cut down to their appropriate length, their weights are reduced by the amount of weight lost from the length reduction. In order to address the issue of the difference in swingweight, the descending weight shaft approach adjusts and modifies the weight of other components of a golf club such as the head or the grip. Because no attempt is made to adjust the weights and swingweights of the shaft themselves, all the shafts within a set of irons can be manufactured together utilizing the same manufacturing specifications, reducing the manufacturing costs. The descending weight shaft approach, although effective in reducing manufacturing costs, is ineffective in adjusting the swingweight of the individual shafts, and relies on adjustments of other components of the golf club that requires added design complexity of one or more of the other components and additional steps at the assembly stage. This additional design complexity and the additional manual assembly step can often be undesirable as it increases production cost of a golf club.

Hence, it can be seen that there is a need in the field for a golf club shaft that is capable of minimizing or eliminating the variations in the swingweight of a golf club by focusing on the shaft itself without the expensive manufacturing expenses associated with independently manufacturing each golf club shaft or expensive adjustment weights associated with final adjustments in other components or the finished product. More specifically, there is a need for a golf club shaft that can be uniformly manufactured and cut down to the desirable length to match the various length of an iron set all while minimizing or even eliminating the variations in the swingweight of the golf club shaft.

BRIEF SUMMARY OF THE INVENTION

In one aspect of the present invention is a plurality of golf clubs comprising of a first golf club containing a first shaft, and a second golf club containing a second shaft; wherein the second shaft is formed by cutting down the length of the first shaft; and wherein an internal wall profile within the first shaft allows the second golf club to have a total moment about a second fulcrum to be similar to a total moment about a first fulcrum of the first golf club.

In another aspect of the present invention is a golf club comprising of a grip connected to a first end of the golf club, a head connected to a second end of the golf club, and a shaft interposed between the head and the grip containing an internal wall profile; wherein the internal wall profile causes a moment of the shaft about a fulcrum to change from 10 gram·inchs to 50 gram·inchs for each half inch reduction in the shaft length.

In a further aspect of the present invention is a method of minimizing a swingweight variation within a plurality of golf clubs comprising of reducing the length of a first shaft by a half inch to produce a second shaft, and adjusting an internal wall profile of the first shaft; wherein the second shaft has a second shaft moment about a fulcrum that varies 10 gram·inchs to 50 gram·inchs when compared to a first moment about a fulcrum of the first shaft.

These and other features, aspects and advantages of the present invention will become better understood with references to the following drawings, description and claims.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

The present invention generally provides a golf club shaft that has a pre-formed internal wall thickness profile geometry shaped in a way that minimizes or eliminates the changes in the swingweight within a set of golf clubs; hence allowing an uniform manufacturing technique for all shafts within a set of golf clubs. More specifically, the present invention relates to a shaft with a unique pre-formed internal wall profile that can be cut down to the desired length to match the required length of a specific iron without the need to make external adjustments to the swingweight. The current invention is unlike the prior art golf club shafts, where in order to achieve a constant swingweight within a set of golf clubs has to either individually manufacture each shaft to a different specification or make significant external adjustments to other components before or after assembly to compensate for the difference in swingweight.

Figure 1:
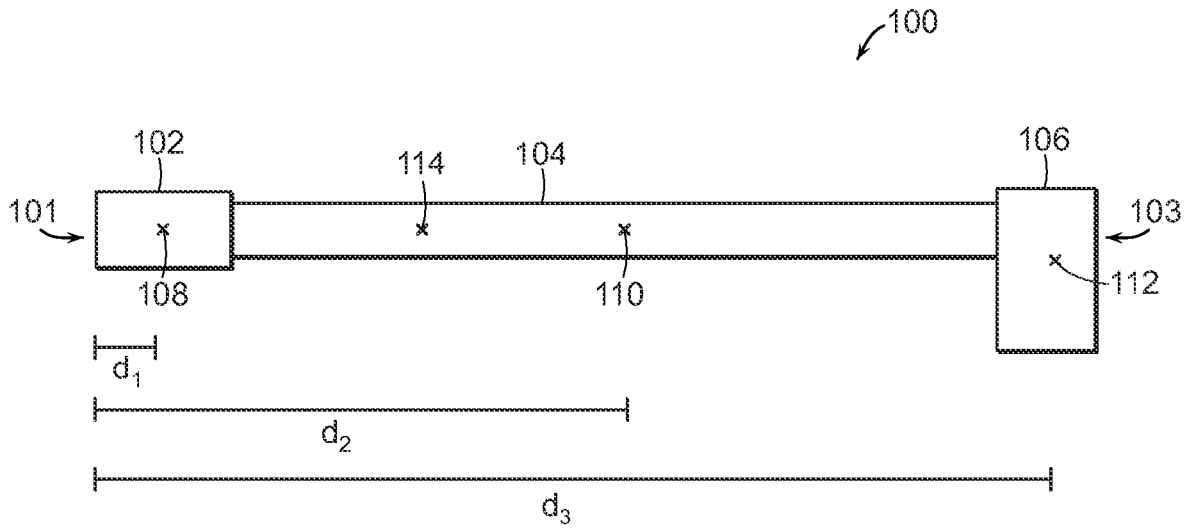
FIG. 1 shows an exemplary golf club head wherein demonstrating the calculation of moment about a fulcrum.

Turning now to FIG. 1 which shows an embodiment of the present invention wherein calculation of the center of gravity, the moment of inertia for each of the individual components of a golf club, and the total moment about the entire golf club can be shown. More specifically, FIG. 1 is capable of establishing a relationship between the moment of a golf club and the swingweight. Here, golf club 100, has a grip 102 at a first end 101 of golf club 100. Connected to the grip 102 is a shaft 104 which may serve as a connecting apparatus between grip 102 and the head 106. The head 106 may be connected to the distal or second end 103 of the golf club 100. Each of the above mentioned components has its own center of gravity, which in theory is a point where the system's mass behaves as if it were concentrated at that point. Alternatively speaking, the center of gravity of a golf club component can often be the balance point of the individual components along the lengthwise direction. Here, as shown in the current exemplary embodiment, center of gravity of grip 108 may be located near the grip 102, the center of gravity of the shaft 110 may be located near the shaft 104, and the center of gravity of the head 112 may be located near the head 106 all without departing from the scope and content of the present invention.

In order to determine the swingweight of a golf club, it is important to recognize the concept of the fulcrum 114 and its location relative to a golf club 100. In this current exemplary embodiment, the fulcrum 114 may generally be at a location that is fourteen inches away from the first end 101 or the butt end of the golf club 100. The fulcrum 114 relates to the swingweight of a golf club 100 in a way such that the swingweight is determined as the sum of all the moment of each of the components about the above mentioned fulcrum point 114. In this current exemplary embodiment containing three components, the total moment of golf club head 100 may generally be simplified as follows:

$$W_{grip}(d_1-14)+W_{shaft}(d_2-14)+W_{head}(d_3-14)=\text{Total Moment} \quad (1)$$

As it can be seen from FIG. 1, the distances $d_1$, $d_2$, and $d_3$, are distances of the center of gravity of each of the components, as measured from the first end 101 or the butt end of the golf club 100. The weight of each of the components, depicted by the symbol W is depicted as $W_{grip}$, $W_{shaft}$, and $W_{head}$. The moment of each of the components of a golf club 100 such as the grip 102, the shaft 104, and the head 106 may be calculated by multiplying the weight of each of the component such as $W_{grip}$, $W_{shaft}$, and $W_{head}$ with each of their respective distance relative to the fulcrum 114. For identification purposes, the moment of each of the components may also be identified as a singular variable simplified as $M_{grip}$, $M_{shaft}$, and $M_{head}$. The sum of all the total moments within the golf club head 100 such as $M_{grip}$, $M_{shaft}$, and $M_{head}$, as depicted in Equation (1) by the product of the weight and distances, is directly correlated to the swingweight of a golf club 100 based on the Table 1 below.

TABLE 1

| Swingweight | Total Moment (Gram · Inches) |
|---|---|
| C-0 | 5600 |
| C-1 | 5650 |
| C-2 | 5700 |
| C-3 | 5750 |
| C-4 | 5800 |
| C-5 | 5850 |

TABLE 1-continued

| Swingweight | Total Moment (Gram · Inches) |
|---|---|
| C-6 | 5900 |
| C-7 | 5950 |
| C-8 | 6000 |
| C-9 | 6050 |
| D-0 | 6100 |
| D-1 | 6150 |
| D-2 | 6200 |
| D-3 | 6250 |
| D-4 | 6300 |
| D-5 | 6350 |
| D-6 | 6400 |
| D-7 | 6450 |
| D-8 | 6500 |
| D-9 | 6550 |
| E-0 | 6600 |

It should be noted that although the current exemplary embodiment depicted in FIG. 1 may only the contain 3 essential elements to golf club 100; namely the grip 102, the shaft 104, and the head 106; various other minor components could also contribute to the moment and swingweight of golf club 100 such as a ferrule, a shaft tip insert, a tape, an epoxy, or any other minor components generally installed in a golf club all without departing from the scope of the present invention.

As it can be seen from above in Table 1, each 50 gram·inches variation of the total moment equates to one swingweight shift. The current invention, through the adjustment of the internal wall profiles, may allow various golf clubs within a set of irons to minimize the variation in the swingweight, or even maintain the swingweight of each of the golf clubs within a set of irons despite its variations in length. More specifically, the current invention may achieve this by utilizing a shaft with a unique internal wall thickness profile throughout the entire range of the set of irons, wherein the unique internal wall thickness profile will allow each individual shaft to be cut down to the desirable length while minimizing swingweight variations.

In order to determine the unique internal wall profile required, a focus may be placed on the calculation of the total moment variations of each of the golf clubs within a set of irons, especially paying close attention to the moment changes for each of the individual components such as the grip 102, the shaft 104, and the head 106. Table 2 below shows an exemplary calculation of the moment changes across an exemplary set of irons ranging from a 2 iron to a 9 iron. Here, as it can be seen, the weights and moments are determined based on each of the components of a golf club 100 as depicted in the FIG. 1 setup. Ultimately, the moment of each of the individual components of grip 102, shaft 104, and head 106 can be seen below:

TABLE 2

| Club Number | Grip Weight | d1 | $M_{grip}$ (Moment of Grip) | Shaft Weight | Total Shaft Length | d2 | $M_{shaft}$ (Moment of Shaft) | Head Weight | d3 | $M_{head}$ (Moment of Head) |
|---|---|---|---|---|---|---|---|---|---|---|
| 2 | 50 | 4 | −500 | 105.84 | 38.75 | 18.1 | 436.602 | 236 | 39.07 | 5915.718 |
| 3 | 50 | 4 | −500 | 104.40 | 38.25 | 17.9 | 404.55 | 242 | 38.60 | 5953.176 |
| 4 | 50 | 4 | −500 | 103.10 | 37.75 | 17.6 | 367.294 | 248 | 38.13 | 5985.034 |
| 5 | 50 | 4 | −500 | 102.00 | 37.25 | 17.4 | 344.25 | 254 | 37.67 | 6011.291 |
| 6 | 50 | 4 | −500 | 100.70 | 36.75 | 17.1 | 314.688 | 261 | 37.20 | 6055.148 |
| 7 | 50 | 4 | −500 | 99.10 | 36.25 | 16.9 | 284.913 | 268 | 36.73 | 6092.471 |
| 8 | 50 | 4 | −500 | 97.90 | 35.75 | 16.6 | 250.869 | 275 | 36.27 | 6123.260 |
| 9 | 50 | 4 | −500 | 96.40 | 35.25 | 16.3 | 222.925 | 283 | 35.80 | 6169.315 |

As each of the individual component moments are calculated across the range of the exemplary set of irons, the total moment variation needs to be calculated based on equation (1) above yielding the total moment that needs to be the maintained across the iron set to achieve constant swingweight. More specifically, the unique internal wall profile needs to be adjusted in a way to compensate for the moment changes in the moment in the club head 106 that is getting heavier, as well as the change in the moment of the shaft 104 getting shorter and lighter. Table 3 below shows a summation of all the moment variations for each of the components within a golf club 100:

TABLE 3

| Total Moment of Club | Change in Total Moment |
|---|---|
| 5852.319386 | |
| 5857.7258 | 5.406414286 |
| 5852.32735 | −5.39845 |
| 5855.541 | 3.21365 |
| 5869.8353 | 14.2943 |
| 5877.3833 | 7.548 |
| 5874.12875 | −3.25455 |
| 5892.2401 | 18.11135 |

This total change in moment can be misleading in terms of the total amount of moment needed to be compensated by the exemplary shaft 104 in accordance with the present invention, because the total moment already takes in consideration of the change in moment by the mere reduction in length. In order to properly determine the amount of moment that needs to be compensated by the unique internal wall thickness profile of the shaft 104, a focus needs to be placed on the change in the moment of the head 106 (shown below in Table 4), and the variation in moment generated by head 106 can determine the amount of moment that needs to be compensated by shaft 104.

TABLE 4

| Moment of Head | Change in Head Moment |
|---|---|
| 5915.718 | |
| 5953.176 | 37.4582 |
| 5985.034 | 31.8578 |
| 6011.291 | 26.2574 |
| 6055.148 | 43.8568 |
| 6092.471 | 37.323 |
| 6123.26 | 30.7892 |
| 6169.315 | 46.0551 |

It should be noted from Table 4 above that the amount of moment that needs to be compensated by the shaft 104 between a first shaft and a second shaft should be approximately 10 gram·inches to approximately 50 gram·inches, more preferably within the range of approximately 15 gram·inches to approximately 50 gram·inches, and even more preferably approximately 20 gram·inches to approximately 50 gram·inches to counteract the moment change in the head. The moment of shaft 104 may generally be calculated from the fulcrum 114 of the shaft 104 without departing from the scope of the present invention. It should also be noted that the distance changes from shaft to shaft may generally be approximately half an inch in accordance with an exemplary embodiment of the present invention; however, different variations of length reduction may be used to determine the length of the specific club all without departing from the scope and content of the present invention.

In order to create a plurality of shafts 104 in accordance with the present invention, the plurality of blank shafts is created to be identical in length, width, and internal wall profile. This blank shaft may be used to make a first shaft, a second shaft, a third shaft, a fourth shaft, a fifth shaft, a sixth shaft, a seventh shaft, an eight shaft, a ninth shaft, or any number of shaft required by set of irons all without departing from the scope and content of the present invention. In order minimize the moment changes, the internal wall profile of the blank shaft is shaped in a way that changes the moment to be approximately 10 gram·inches to approximately 50 gram·inches, more preferably within the range of approximately 15 gram·inches to approximately 50 gram·inches, and even more preferably approximately 20 gram·inches to approximately 50 gram·inches per half inch reduction in shaft 106 length to counteract the moment change in the head 106 as indicated above. Because of this unique internal wall profile, the blank shaft may be trimmed to any desired length while being applicable towards any iron club within a set without the need to adjust for swingweight variations.

Figure 2:
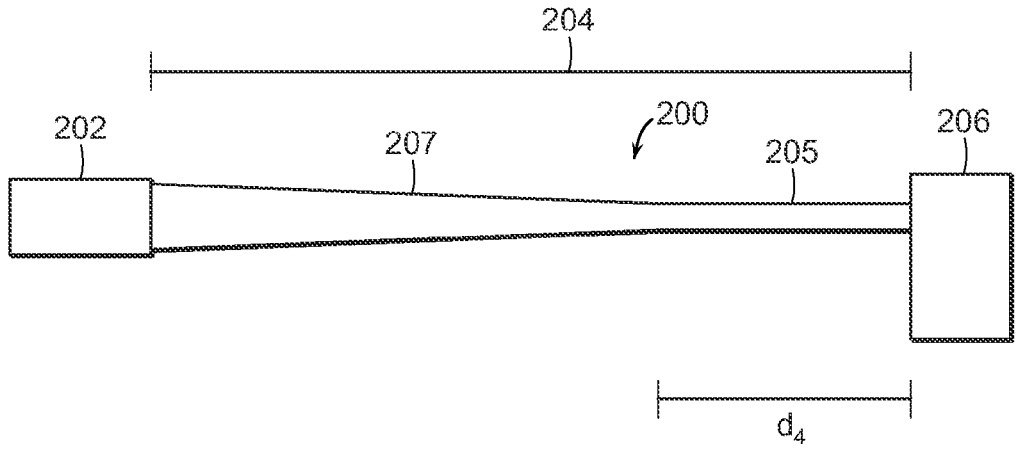
FIG. 2 shows a prospective view of a golf club in accordance with the present invention.

FIG. 2 shows an embodiment of the current invention wherein the shaft 204 has a parallel tip section 205 and a tapered shaft section 207. The parallel tip section 205 is shown in the current exemplary embodiment to keep the external wall at the parallel tip section 205 parallel to each other for a predetermined distance $d_4$. Alternatively speaking, the current exemplary embodiment depicted in FIG. 2 may have a parallel tip section 205 that has a constant outer diameter, while the tapered shaft section 207 has a decreasing outer diameter from the grip 202 to the parallel tip section 205. Predetermined parallel tip distance $d_4$, as shown in this current exemplary embodiment, may have a distance that may be between the ranges of approximately 2.5 inches to approximately 12 inches, preferably between approximately, 2.5 inches to approximately 10 inches, more preferably between approximately 2.5 inches to approximately 8 inches. Parallel tip section 205 may generally allow for a same shaft to be trimmed down while maintaining the outer diameter to fit inside a hosel of a golf club head 206. In order to adjust for the length variation in a the current exemplary embodiment, excessive material may generally be removed from the parallel tip section 205 at the tip end of the shaft 204; however because of the unique internal wall profile, the removal of the excessive material from the tip end of shaft 204 will have minimal to no effect in the overall swingweight of golf club 200. Additionally, it should be noted that the outer parallel tip section may be reformed into a shorter tapered outer section in a secondary manufacturing process step. This minor tapered length may generally be of no more than four inches, and may generally be added to fit the shaft into a tapered hosel bore head. This outer tapered section can be formed to create a shaft without a parallel tip section 205 without departing from the scope and content of the present invention. Hence, although each of the below exemplary embodiments shown below may have a parallel tip section 205, the external wall profile of each of the below exemplary embodiments may also utilize a tapered tip section without departing from the scope and content of the present invention.

Figure 3A:
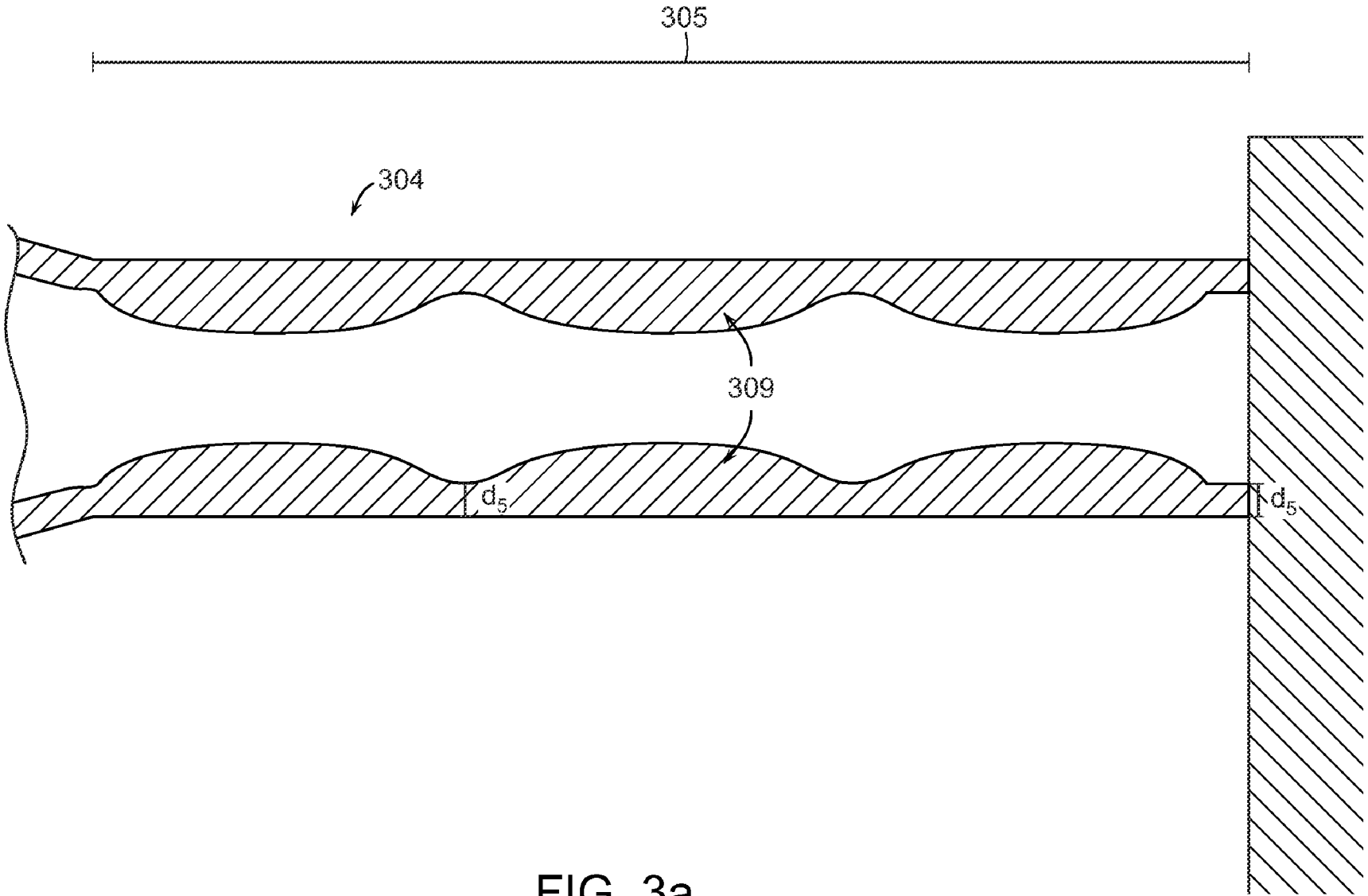
FIG. 3*a* shows a cross-sectional view of an internal wall thickness profile of a golf club shaft in accordance with the present invention.

Moving on to FIG. 3*a*, which shows an enlarged crossed-sectional view of the parallel tip section 305 of a shaft 304 in accordance with one embodiment of the present invention. The internal wall profile may be in a sinusoidal shape across the entire range of the parallel tip section 305 to adjust for the change in the moment created by the shortening of the shaft as well as the change in head weight variation. However, the sinusoidal shape of the internal wall profile 309 could only partially extend across the range of the parallel tip section 305 without departing from the scope of the present invention. Because the ultimate swingweight variation of the golf club needed may not be a truly linear function with respect to the reduction in shaft length and the change in head weight, the internal wall profile 309 of the parallel tip section 305 may fluctuate in a sinusoidal wave shape to correspond with the swingweight variation of a golf club.

Figure 3B:
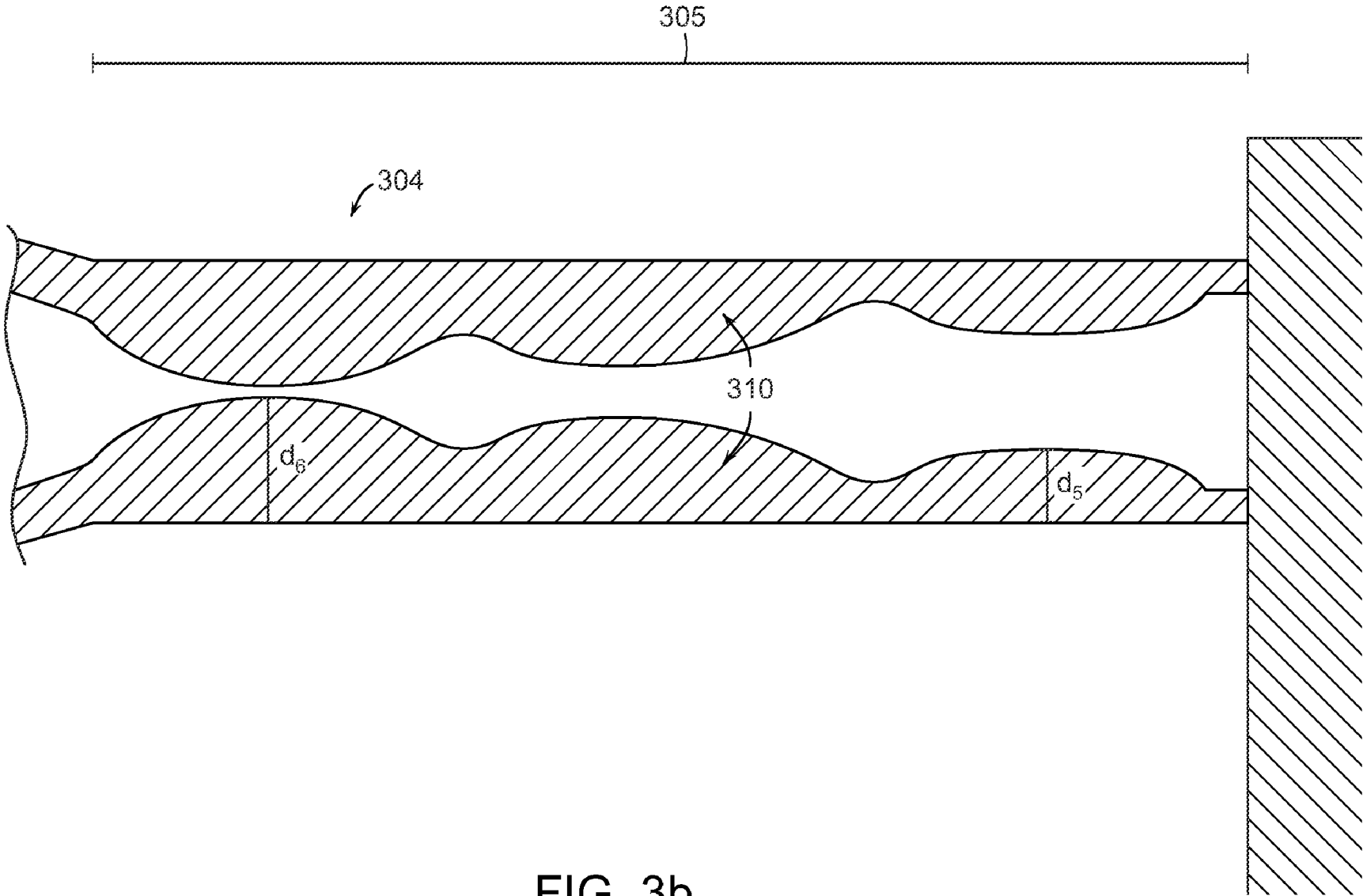
FIG. 3*b* shows a cross-sectional view of an internal wall thickness profile of a golf club shaft in accordance with an alternative embodiment of the present invention.

FIG. 3*a*, as current shown, shows an exemplary embodiment with three periods of a sinusoidal wave internal wall profile 309. However, it should be noted that numerous other number of periods may be used ranging from one period, two periods, four periods, five periods, six periods, or any number of periods matching the moment adjustment needs of the shaft may be used all without departing from the scope and content of the present invention. In this alternative embodiment shown in FIG. 3*a*, it should be noted that the sinusoidal like shape of the internal wall profile may generally have an amplitude across the entire parallel tip section 305. To put in another way, the current exemplary embodiment may have a uniform thickness of $d_5$ at all the peaks of the sinusoidal waves of the shaft within the parallel tip section 305. However, it should be noted that shaft 304 may also have a sinusoidal internal wall profile 310 with a varying amplitude that could creating various thickness such as $d_5$ and $d_6$ along the peaks of the sinusoidal wave of the parallel tip section 305 as shown in FIG. 3*b* without departing from the scope and content of the present invention. It should also be noted that although the exemplary embodiment shown in FIG. 3*b* may have a distance $d_6$ be thicker than $d_5$, the $d_5$ could be thicker than $d_6$, causing a decreasing internal wall thickness towards the tip of the shaft also without departing from the scope and content of the present invention.

Figure 4:
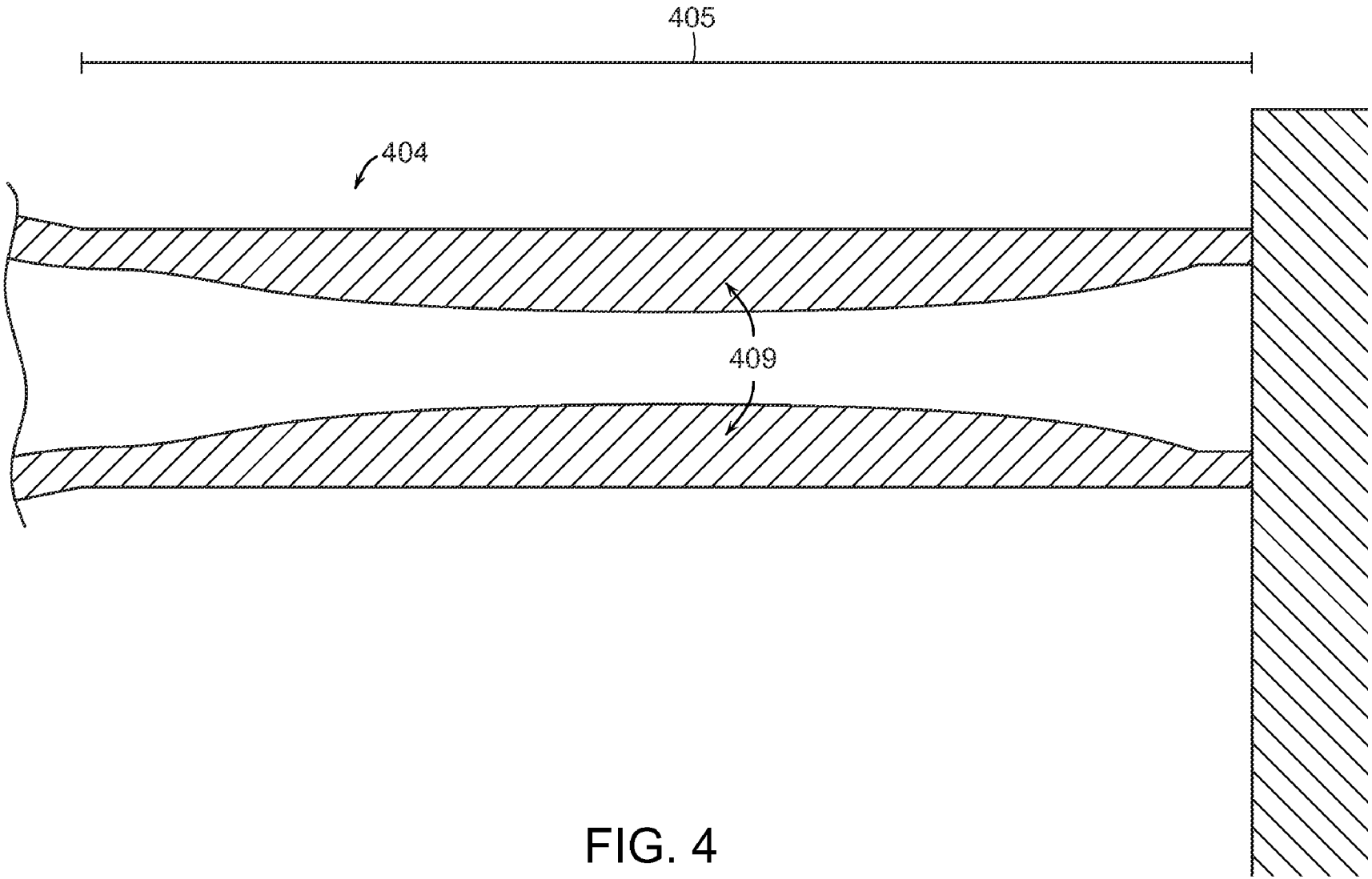
FIG. 4 show a cross-sectional view of an internal wall thickness profile of a golf club shaft in accordance with a further alternative embodiment of the present invention.

FIG. 4 shows an enlarged cross-sectional view of the parallel tip section 405 of a shaft 400 in accordance with an alternative embodiment of the present invention. In this current alternative embodiment, the internal wall profile 409 may be in the shape of a bulge extending from the internal wall of the parallel tip section 405 towards the central axis of the shaft. The internal wall profile 409 here may adjust for the moment variations that cause a difference in swingweight by varying the wall thicknesses at various sections to compensate for the weight adjustment needed. In this alternative embodiment, a different weight arrangement and set up of a golf club head, length, and shaft may require a different bulged shape internal wall profile 409 to achieve the constant swingweight across the entire set of irons.

Figure 5:
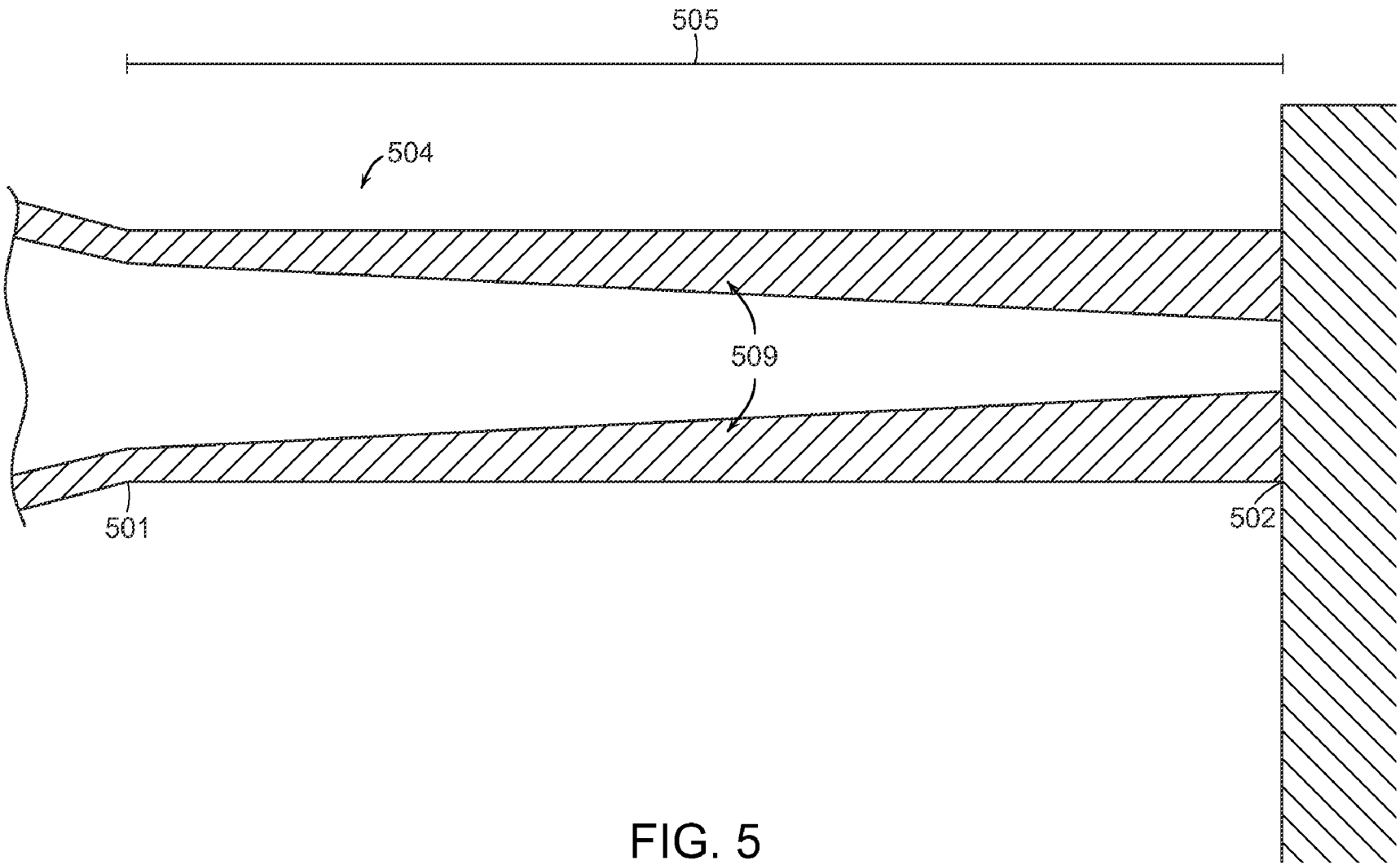
FIG. 5 shows a cross-sectional view of an internal wall thickness profile of a golf club shaft in accordance with an even further alternative embodiment of the present invention.

FIG. 5 shows another alternative embodiment of the present invention wherein the parallel tip section 505 of shaft 500 has a cross-section that shows an internal wall profile 509 that is linear. Internal wall profile 509, as shown in the current alternative embodiment, may be increasing in wall thickness from the distal end 501 of the parallel tip section 505 to the tip end 502 of the parallel tip section 505. In this alternative embodiment, the different arrangement and set up of a golf club head, length, and shaft may require a different linear internal wall profile 509 in accordance with FIG. 5 to minimize swingweight variations across the entire set of irons.

Figure 6A:
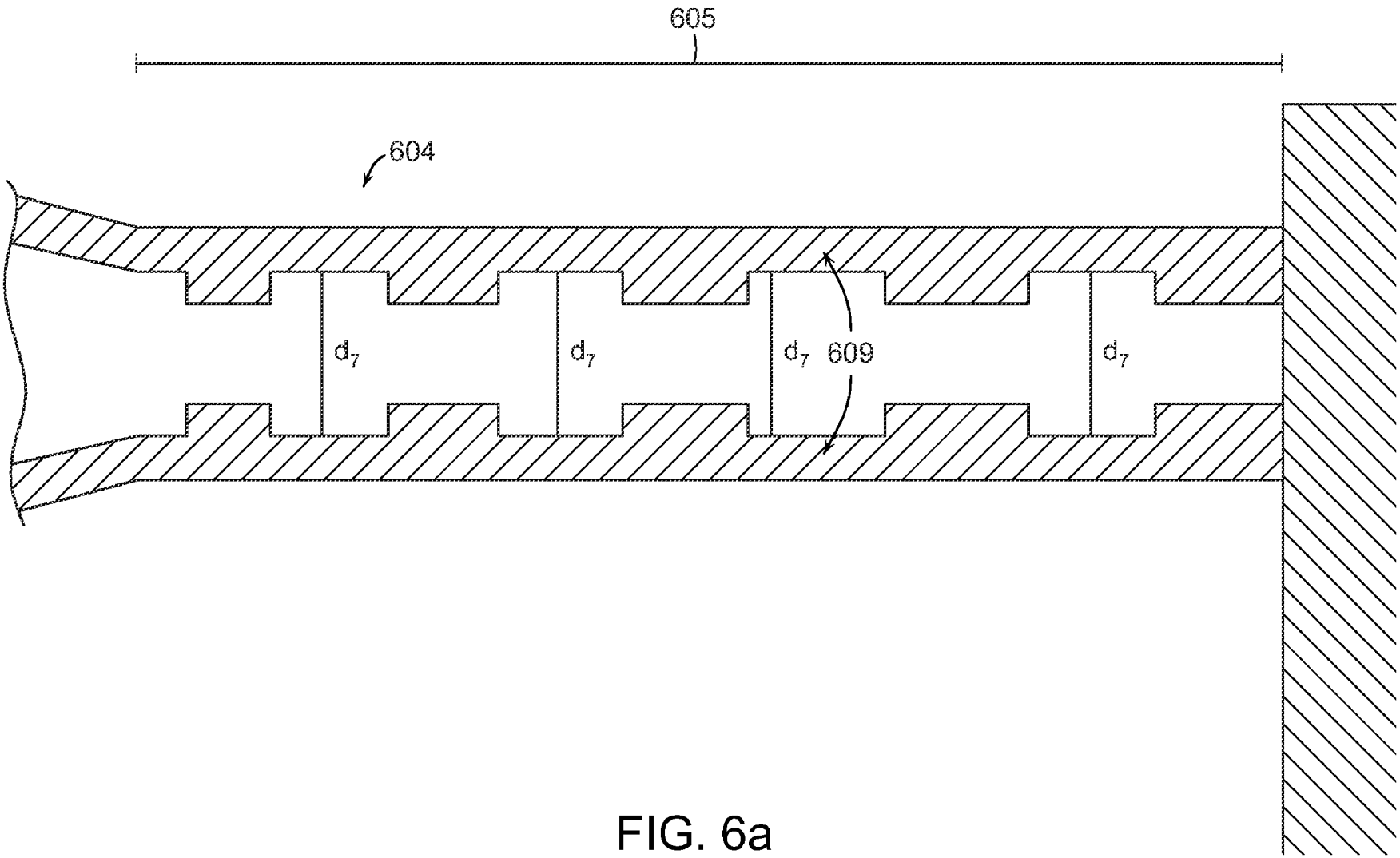
FIG. 6*a* shows a cross-sectional view of an internal wall thickness profile of a golf club shaft in accordance with an even further alternative embodiment of the present invention.

FIG. 6*a* shows a further alternative embodiment of the present invention wherein the parallel tip section 605 of shaft 600 has a cross-section that shows an internal wall profile 609 that is stair-stepped. Internal wall profile 609, as shown in the current alternative embodiment is in a stair-stepped shape to assist with the removal of additional weight within the internal walls of the shaft in a method that preserves a semi-parallel internal wall profile 609. In this alternative embodiment, the different arrangement and set up of golf club head, length, and shaft may require an even further different internal wall profile 609 in accordance with FIG. 6*a* to achieve the constant swingweight across the entire set of irons.

Figure 6B:
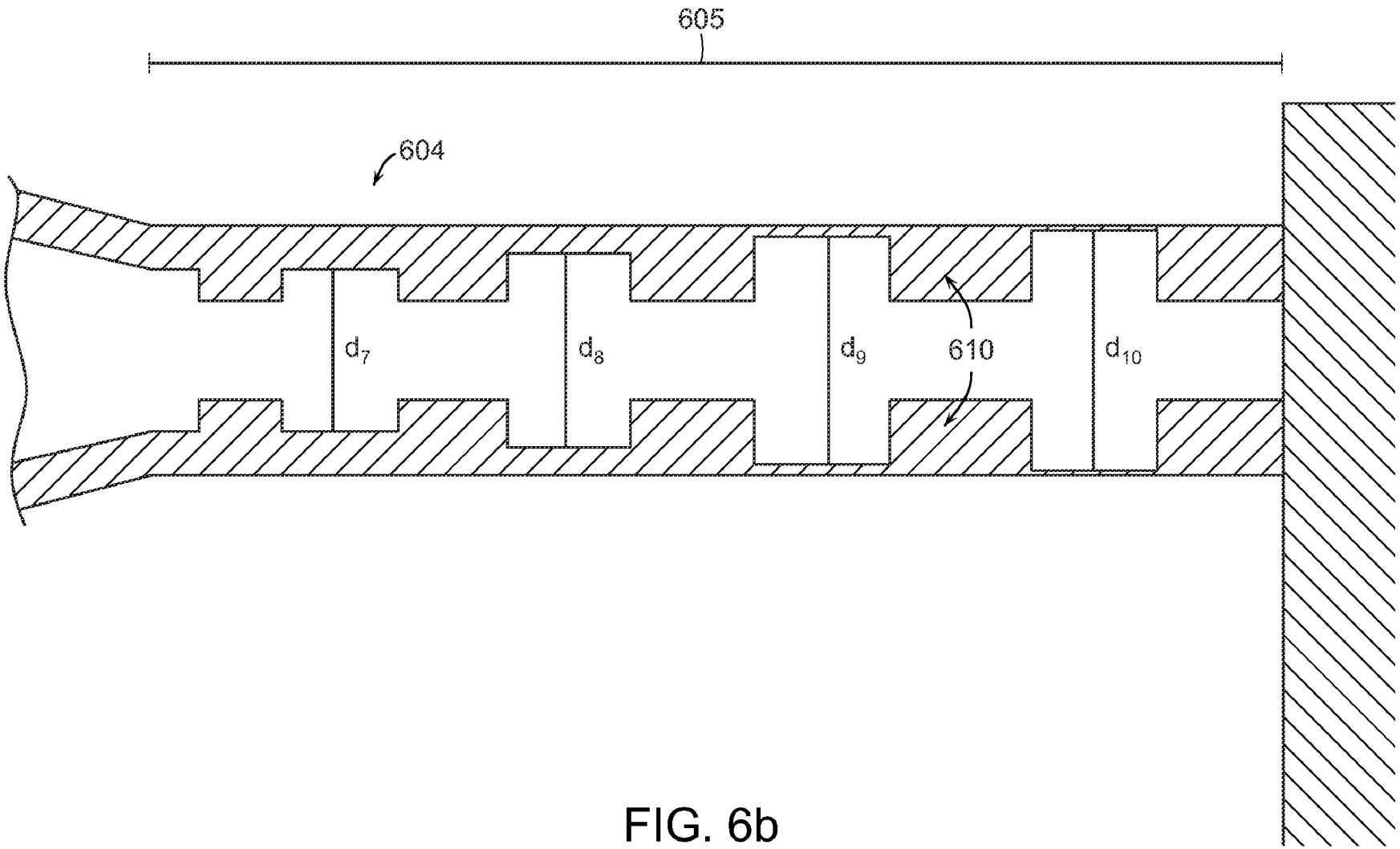
FIG. 6*b* shows a cross-sectional view of an internal wall thickness profile of a golf club shaft in accordance with an even further alternative embodiment of the present invention.

Here, in the current alternative embodiment shown in FIG. 6*a*, the stair stepped internal wall profile 609 may have squared edges, however, stair stepped internal wall profile 609 may have rounded edges, circular edges, or any other edge shape capable of adjusting the weight of shaft 600 to compensate for the swingweight variation all without departing from the scope of the present invention. It should be noted that each of the stair-stepped teeth in FIG. 6*a* all have the same thickness $d_7$; however, each of the teeth may have a also different thickness ranging increasing from $d_7$, $d_8$, $d_9$, and $d_{10}$ towards the tip of the shaft as shown in FIG. 6*b* without departing from the scope and content of the present invention. It should be noted that although in this exemplary embodiment shown in FIG. 6*b* $d_{10}$ may be thicker than $d_7$, the $d_7$ could be thicker than $d_{10}$, causing an increasing internal wall thickness towards the tip of the shaft also without departing from the scope and content of the present invention.

Figure 7:
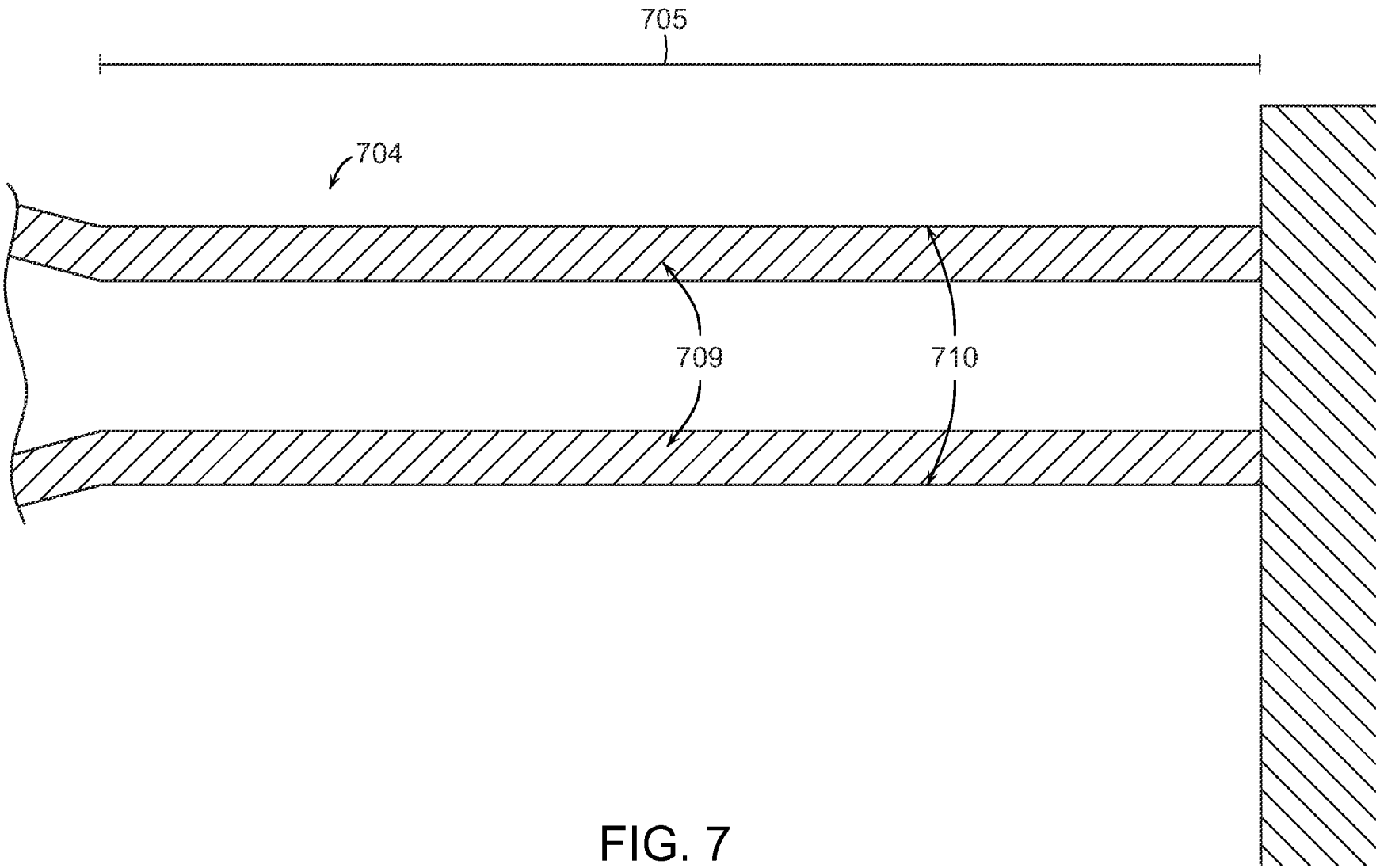
FIG. 7 shows a cross-sectional view of an internal wall thickness profile of a golf club shaft in accordance with an even further alternative embodiment of the present invention.

FIG. 7 shows an even further alternative embodiment of the present invention wherein the parallel tip section 705 of shaft 700 has a cross-section that shows an internal wall profile 709 that is linear and parallel to the external wall profile 710. Internal wall profile 709, as shown in the current alternative embodiment is parallel to the external wall profile 710 throughout the entire duration of the parallel tip section 705, however, the internal wall profile 709 could only partially cover the parallel tip section 705 without departing from the scope and content of the present invention. In this alternative embodiment, the different arrangement and set up of a golf club head, length, and shaft may require an even further different internal wall profile 709 in accordance with FIG. 7 to achieve the constant swingweight across the entire set of irons.

Figure 8:
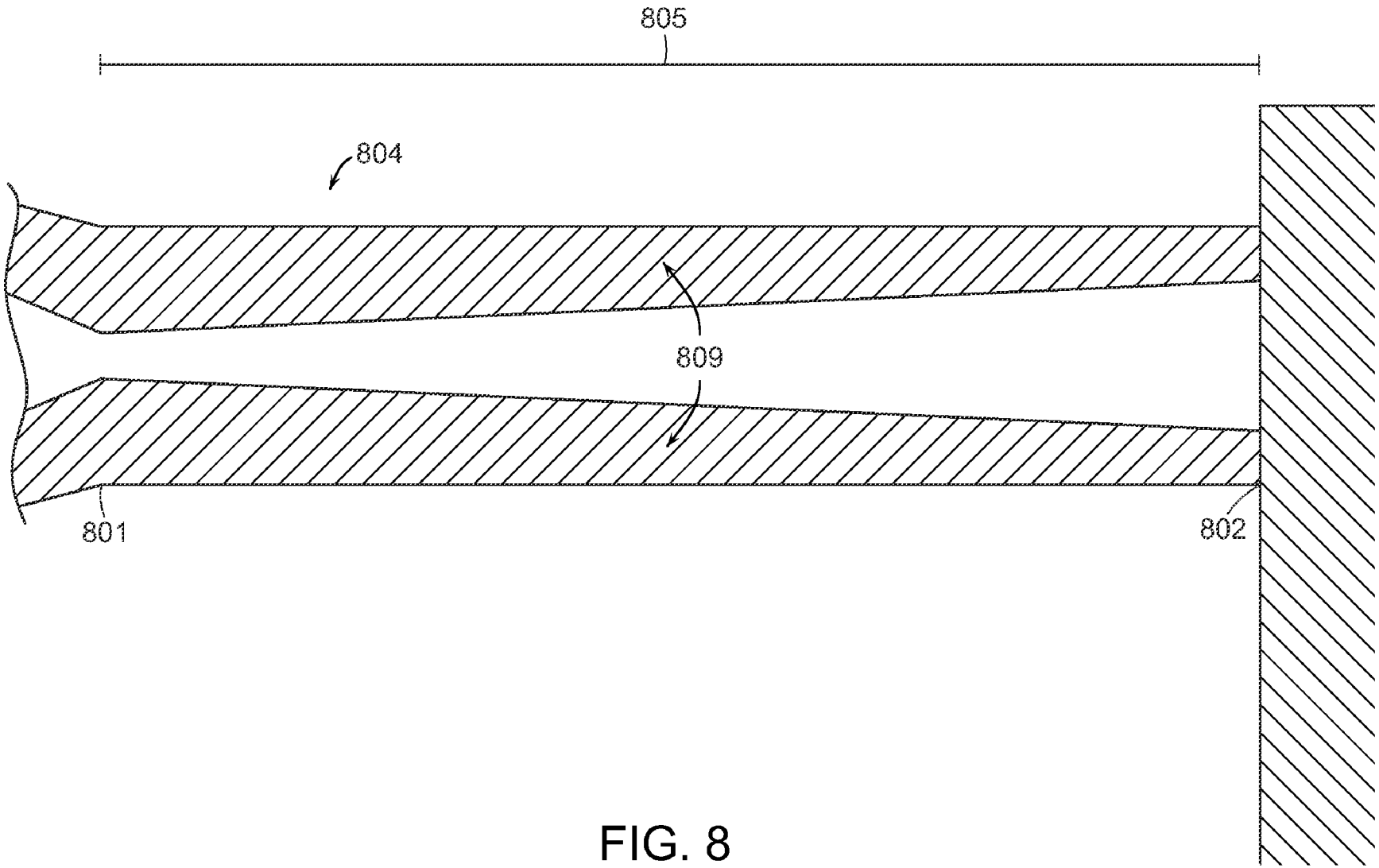
FIG. 8 shows a cross-sectional view of an internal wall thickness profile of a golf club shaft in accordance with an even further alternative embodiment of the present invention.

FIG. 8 shows an even further alternative embodiment of the present invention wherein the parallel tip section 805 of shaft 800 has a cross-sectional that shows an internal wall profile 805 that is that is linear. Internal wall profile 809, as shown in the current alternative embodiment may be decreasing in wall thickness from the distal end 801 of the parallel tip section 805 to the tip end 802 of the parallel tip section 805. In this alternative embodiment, the different arrangement and set up of a golf club head, length, and shaft may require an even further different internal wall profile 809 in accordance with FIG. 8 to minimize swingweight variations across the entire set of irons.

It should be understood, of course, that the foregoing relates to exemplary embodiments of the present invention and that modifications may be made without departing from the spirit and scope of the invention as set forth in the following claims. More specifically it should be understood that although various internal wall profiles have been shown here to accommodate various weight arrangement and set up of a golf club heads, lengths, and shafts, the current invention is not limited to these disclosed internal wall profiles. Various other internal wall profiles such as a triangular shape, zigzag shape, non-uniform shapes, or any other shape that is capable of compensating for the change in moment of a golf club despite the reduction in shaft length may also be used without departing from the scope of the present invention.

What is claimed is:

1. A golf club comprising:

a grip connected to a first end of said golf club;

a head connected to a second end of said golf club; and a shaft interposed between said head and said grip containing an internal wall profile, wherein said internal wall profile causes a moment of said shaft about a fulcrum to change from 30 gram·inches to 50 gram·inches for each half inch reduction in said shaft length for a length of no less than 2.5 inches wherein said fulcrum is located 14 inches away from said first end of said golf club and wherein said internal wall profile is sinusoidal in shape.

2. The golf club of claim 1, wherein said half inch reduction in said shaft length is achieved by cutting said shaft at said second end of said club.

3. The golf club of claim 2, wherein said shaft has a constant outer diameter at said second end of said golf club for a distance of from 2.5 inches to 12 inches.

4. The golf club of claim 3, wherein said sinusoidal internal wall profile is only applicable to said constant outer diameter portion of said shaft.

* * * * *